US012421696B2

(12) United States Patent
Kean et al.

(10) Patent No.: US 12,421,696 B2
(45) Date of Patent: Sep. 23, 2025

(54) CONTROLLING OF A DUMPING OF A LOAD OF AN EARTH MOVING MACHINE

(71) Applicant: LEICA GEOSYSTEMS TECHNOLOGY A/S, Odense Sø (DK)

(72) Inventors: Michael Goulet Kean, Odense Sø (DK); Tommi Juhani Kauppinen, Odense C (DK)

(73) Assignee: LEICA GEOSYSTEMS TECHNOLOGY A/S, Odense Sø (DK)

( * ) Notice: Subject to any disclaimer, the term of this patent is extended or adjusted under 35 U.S.C. 154(b) by 242 days.

(21) Appl. No.: 18/233,147

(22) Filed: Aug. 11, 2023

(65) Prior Publication Data

US 2024/0052605 A1 Feb. 15, 2024

(30) Foreign Application Priority Data

Aug. 12, 2022 (EP) ..... 22190189

(51) Int. Cl.
*E02F 9/26* (2006.01)
*E02F 3/32* (2006.01)
*E02D 1/02* (2006.01)

(52) U.S. Cl.
CPC ..... *E02F 9/265* (2013.01); *E02F 3/32* (2013.01); *E02F 9/262* (2013.01); *E02D 1/022* (2013.01)

(58) Field of Classification Search
CPC ..... E02F 9/20; E02F 9/2025; E02F 9/2029; E02F 9/2041; E02F 9/2045; E02F 9/22; E02F 9/221; E02F 9/2214; E02F 9/2221; E02F 9/26; E02F 9/261; E02F 9/262; E02F 9/264; E02F 9/265; E02F 9/267; E02F 9/268; E02F 3/84; E02F 3/841;
(Continued)

(56) References Cited

U.S. PATENT DOCUMENTS 3,997,068 A * 12/1976 Lock ..... E02F 3/40 414/723
11,346,086 B1 * 5/2022 Kikani ..... E02F 9/2041
(Continued)

FOREIGN PATENT DOCUMENTS

DE 10 2018 216369 A1 3/2020
EP 3 812 517 A1 4/2021
JP H05321560 A * 12/1993 ..... E21B 11/00

OTHER PUBLICATIONS

Miedema, 2.4 Soil Mechanical Parameters from Book: The Delft Sand, Clay and Rock Cutting Model, 2014, LibreTexts Engineering (Year: 2014).*

(Continued)

*Primary Examiner* — Ramya P Burgess
*Assistant Examiner* — Sara J Lewandroski
(74) *Attorney, Agent, or Firm* — Maschoff Brennan

(57) ABSTRACT

An improved controlling of a dumping of a load of an earth moving machine, which has a conveying container configured for carrying the load. Control data for maneuvering the conveying container according to a selected dumping mode are generated by analyzing perception data and/or machine sensing data to determine a material parameter providing information on an adhesive property of a current load of the conveying container. Based on the material parameter, an appropriate dumping mode is selected, e.g. to improve efficiency of the unloading sequence and to reduce wear of the earth moving machine.

18 Claims, 4 Drawing Sheets

(58) Field of Classification Search
CPC . E02F 3/842; E02F 3/844; E02F 3/845; E02F 3/847; A01B 79/00; A01B 79/005; A01B 79/02; G01N 21/3554; E02D 1/00; E02D 1/02; E02D 1/022
See application file for complete search history.

(56) References Cited

U.S. PATENT DOCUMENTS

| | | | | |
|---|---|---|---|---|
| 11,674,287 | B2 * | 6/2023 | Hirayama | E02F 9/205 701/25 |
| 2013/0173122 | A1 * | 7/2013 | Liu | E02F 9/2029 701/50 |
| 2018/0135273 | A1 * | 5/2018 | Tsuji | E02F 9/265 |
| 2020/0063399 | A1 * | 2/2020 | Miller | E02F 9/265 |
| 2020/0095749 | A1 | 3/2020 | Stark et al. | |
| 2020/0095751 | A1 * | 3/2020 | Nishimura | E02F 9/264 |
| 2020/0131731 | A1 * | 4/2020 | Wu | E02F 3/439 |
| 2020/0240105 | A1 * | 7/2020 | Ready-Campbell | E02F 3/439 |
| 2020/0263384 | A1 | 8/2020 | Currier | |
| 2020/0325655 | A1 * | 10/2020 | Hageman | E02F 3/3486 |
| 2023/0392345 | A1 * | 12/2023 | Yoshida | E02F 3/435 |
| 2024/0026651 | A1 * | 1/2024 | Nishi | G06T 11/206 |
| 2024/0183131 | A1 * | 6/2024 | Hashimoto | E02F 9/262 |

OTHER PUBLICATIONS

Extended European Search Report dated Feb. 13, 2023 as received in Application No. 22190189.5.

* cited by examiner

CONTROLLING OF A DUMPING OF A LOAD OF AN EARTH MOVING MACHINE

BACKGROUND

The present disclosure relates a method and system for controlling of a dumping of a load of an earth moving machine, such as an excavator or wheel loader, which has a conveying container configured for carrying the load.

Earth moving machines are construction machinery comprising a conveying container. By way of example, an earth moving machine is embodied as one of an excavator, wherein the conveying container is embodied as a bucket, a bulldozer, wherein the conveying container is embodied as a plough-like component, or a wheel loader. Earth moving machines are used in many ways, e.g. for digging, landscaping, and material handling.

The process of the dumping of the load of an earth moving machine, e.g. onto a truck, in a pit, or to a stock pile, can involve a complex sequence of controlling commands to be applied by the operator of the earth moving machine. The demand on required controlling skills by the operator in this step can lower the efficiency of the whole workflow. For example, an industry such as mining or building construction is often subject to high competitive pressure, e.g. wherein on site operations run non-stop and individual work steps have to be performed under high time pressure. In order to provide efficient excavating (including loading and dumping), operators of earth moving machines have to be well trained and skilled.

Excavating processes often need to be executed in an efficient but also precise way. For example, inaccurate unloading of material on a dump truck, where material falls next to the dump truck, can lead to spill on the ground which can damage the tires of the dump truck or other construction machinery moving in that area. Uneven unloading on the dump truck can also lead to an unfavorable weight distribution on the truck, which can cause increased wear and tear. Thus, badly executed excavating results in increased material costs and delayed work process.

Dumping behavior or the spreading of material on the ground is often dependent on adhesive properties of the load of the conveying container. For example, low adhesive material can be easily spread over a larger area by moving the container along a trajectory and slowly opening the container. However, high adhesive material sticks together and will fall as a single "ball of dirt" out of the container, i.e. the material is dumped onto a much more confined area. In case of sticky material, material also sticks to the conveying container and the container is not fully empty after a first opening of the container. Thus, further container movements are necessary to fully empty the container. Insufficient emptying of the conveying container reduces the available container volume for the next excavating process and thus requires more loading and unloading steps.

In the prior art, to ensure that the bucket load is fully dumped the dumping process includes a so-called bucket rap out. The rap out comprises a rotation of the bucket all the way into an abrupt end of stroke, causing a shaking and vibrating of the bucket, which helps to dump sticky material. Some of these systems include the ability to automatically shake the bucket or repeatedly hit the end of stroke to shake sticky material out of the bucket.

However, depending on the type of load, e.g. for a more fluent load such as dry sand, a rap out is not necessary and there are more efficient ways of dumping. Furthermore, the rap out causes wear and fatiguing of earth moving machine components such as joints. Thus, it is desirable to use the rap out only if necessary and to use an automated dumping behavior appropriate to the load, which also raises the efficiency of the dumping process itself.

SUMMARY

It is an object of the present disclosure to provide a system that provides more efficient dumping behavior compared to prior art.

A further object is the provision of an improved dumping system, which reduces wear on the earth moving machine.

A further object is the provision of a dumping system, which reduces skill requirements on operator skills for maneuvering the earth moving machine.

A further object is the provision of a dumping system, which makes unloading more accurate and reproducible.

The disclosure relates to a method for controlling of a dumping of a load of an earth moving machine, which has a conveying container configured for carrying the load. The method comprises a step of accessing sensor data, which comprise machine sensing data and/or perception data capturing a conveying container surrounding and at least part of the conveying container. The machine sensing data provide a machine parameter that is indicative of a force exerted onto the earth moving machine, e.g. onto the conveying container, in reaction to material in the conveying container and/or in reaction to an excavation process by the conveying container. The sensor data are analyzed to determine a material parameter or a set of different material parameters, wherein the material parameter or the set of different material parameters provide information on an adhesive property of a current load of the conveying container. For example, the analyzing of the sensor data provides soil properties comprising at least one of: humidity, color, grain size, and grain type. In a further step, a dumping mode for unloading the conveying container out of different dumping modes is selected based on the material parameter or the set of different material parameters. Then, control data for maneuvering the conveying container according to the selected dumping mode are provided.

By way of example, the different dumping modes comprise a bucket rap out mode providing movement of the conveying container into an abrupt end stop, e.g. causing a shaking and vibrating of the conveying container, and a gradual bucket opening mode providing a shock free unloading of the conveying container.

A further mode may be a so-called kick out mode providing a rapid stop of a movement of the conveying container or a rapid reversion of a movement direction of the conveying container, e.g. using the inertia of the load to quickly empty the conveying container. For example, the kick out mode is provided by rapid reversion of a movement direction of a boom guiding the conveying container or by an application of brakes of the earth moving machine. In some situations like moving large rocks in a quarry one at a time, the kick out mode provides to "toss" of the rocks to relocate them. In other words, a wheel loader may use a slight or abrupt application of the brakes to achieve a very similar result as the arm kick out by an excavator.

Another mode is a so-called flowing spread mode providing a continuous boom motion with a synchronized emptying of the conveying container, e.g. to dump/spread the load evenly along a given trajectory of the conveying container.

By way of example, dumping process information is derived by using the perception data, e.g. wherein the signals from the perception sensors are indicative of a material flow speed from the conveying container. The signals from the perception sensors may also be indicative of a material angle of repose. This allows, for example, to adapt a control parameter of the selected dumping mode (or to change from an initially selected dumping mode to another dumping mode) even during a current dumping operation by taking into account the dumping process information.

In one embodiment, the method comprises providing of load information of the current load based on the material parameter or the set of material parameters, and receiving user input to provide the selecting of the dumping mode. For example, the load information is indicative of the material parameter or the set of material parameters, e.g. wherein the load information provides a user with an indication of an adhesive property of the current load or a material type of the current load.

By way of example, the method is implemented by a system comprising a user interface with a display and an input functionality, e.g. embodied by a touch display, configured to provide the load information to a user and to receive user input on the appropriate dumping mode to be applied for the current load.

In a further embodiment, the selecting of the dumping mode is carried out automatically as a function of the material parameter or the set of material parameters, e.g. wherein for sticky material a rap out is preferred over a gradual bucket opening.

In a further embodiment, the method comprises providing dump area information defining a dump location relative to the earth moving machine, e.g. by user input and/or based on the material parameter or the set of material parameters, and taking into account the dump area information for the providing of the control data. By way of example, this allows to associate a specific dump location, such as a dump bed of a dump-truck or a pit or a stock pile, to the selected dumping mode, thereby restricting the allowable range for the control data. Furthermore, hydraulic actuator movements could be limited as a function of the dump area information to prevent material to be placed outside the dump location.

For example, an allowable dump area is provided by dynamically generating geo fence data defining the dump location to be taken into account by the providing of the control data, e.g. wherein the geo fence data limit the allowable range of the control data.

For example, the dump area information provides an allowable dump area as a function of the material parameter or the set of material parameters, e.g. wherein a set of dump areas with associated relative location information has been defined beforehand and is compared to a value of the material parameter or values of the set of material parameters.

In a further embodiment, the perception data are visual observation data, e.g. comprising camera data and/or 3D coordinate measuring data. For example, the perception data are further used to derive information on a fill state of the conveying container and the selecting of the dumping mode comprises an analyzing of the sensor data for deriving and taking into account an information of a current fill state for the selecting of the dumping mode. Thus, for example, appropriate dumping mode sequences (e.g. of different kinds of dumping modes) can be applied (automatically) based on amount (and type) of material remaining in the conveying container, e.g. to ensure that the bucket load is fully dumped but no excessive stress is exerted on joints of the boom and/or conveying container. The inner shape of an excavator bucket can be scanned, e.g. in 3D, to look for carry back, i.e. material that adhered to the inner surface of the bucket rather than dumping, which is indicative of sticky soils.

Alternatively, or in addition, the sensor data comprise dedicated fill state data, e.g. of a fill level sensor, which provide information on a fill state of the conveying container, wherein the selecting of the dumping mode comprises an analyzing of the dedicated fill state data for deriving and taking into account an information of a current fill state for the selecting of the dumping mode.

In a further embodiment, the method comprises generating of a machine parameter history of values of the machine parameter and using the machine parameter history to determine the material parameter or the set of different material parameters. For example, resistance forces exerted onto the conveying container in reaction to previous excavation processes are indicative of the type of material previously excavated, e.g. given by stickiness or material density. By knowing the location and time of previous excavation processes an assumption can be made on the type of material of a current excavation process, e.g. by realizing that the current excavation process is sufficiently close (in space and time) to the previous excavation processes and, based thereof, assuming similar material type as indicated by the previous processes.

By way of example, the machine parameter history comprises localization and/or time information of an excavating place and/or an excavating time associated with each of the values of the machine parameter. For example, the localization and time information is provided by using a localization unit, e.g. a GNSS based localization unit mounted on the earthmoving machine.

In another embodiment, a time-evolution of previously used dumping modes is generated and used as part of the criteria for the selecting of the dumping mode, to be used for the current or a next dump cycle.

In a further embodiment, the material parameter or the set of different material parameters provides information regarding at least one of a clay proportion, a silt proportion, and sand proportion of the current load. Alternatively, or in addition, the sensor data provide moisture data and the material parameter or the set of different material parameters provides information on moisture of the current load. For example, in soils with a high proportion of clay, strong adhesion and cohesion bonds form, so that the soil tends to stick to the conveying container, e.g. a bucket. In contrast, soils with a high proportion of sand have low adhesion and do not stick to the conveying container.

There are several methods that could be used for deriving the different portions. By way of example, the deriving relies on some form of reference digging information provided by digging well known materials that have been intentionally mixed and being moved under controlled conditions while taking data of the machine digging it. For example, the machine data and known proportions of soil mixture could be used to train a neural network, wherein a state machine is configured to apply a sequence of logical rules to the machine and sensor data in order to determine which general region of the soil chart the soil belongs to. A simple example would be "measurable particle size" indicating the presence of gravel or sand with "measurable voids" potentially indicating washed stone while "no measurable voids" indicate stone mixed with soil.

Other indicators to classify the soil into the different portions are provided by the density, angle of repose in the bucket, heaped volume loaded in the bucket, and the presence or absence of material coating the exterior or interior surfaces of the bucket.

By way of example, the selecting of the dumping mode comprises selecting a dumping mode out of the following different dumping modes:

- a dumping mode invoked by the material parameter or the set of different material parameters indicating a clay proportion of the current load above 60 percent (e.g. soil with high proportion of clay is often sticky, thus a rap out could be the appropriate dumping mode in this case);
- a dumping mode invoked by the material parameter or the set of different material parameters indicating a sand proportion of the current load above 60 percent (e.g. soil with a high proportion of sand has typically lower adhesion bonds, thus an arm kick out could be appropriate) and particularly a further dumping mode invoked by the material parameter or the set of different material parameters indicating a sand proportion of the current load above 90 percent (soils with such a high proportion of sand often have good flowing characteristics, thus a flowing spread mode may be applied particularly well); and
- a dumping mode invoked by the material parameter or the set of different material parameters indicating a silt proportion of the current load above 60 percent.

In a further embodiment, the material parameter or the set of different material parameters categorizes the current load in at least one of the following categories: a category defined by grain properties, namely by grain size and/or flow properties; a category defined by material constitution, namely different proportions of different materials; a category indicative of low adhesion material; and a category indicative of high adhesion material.

By way of example, one way to carry out this categorization is to visually analyze the way the material begins leaving the bucket due to gravity. If the material begins spilling as soon as the bucket is tilted relative to gravity, it has a low adhesion. If the material sticks even once the bucket has opened significantly, then there is a high adhesion. In some cases the material may adhere to the bucket even when the bucket is nearly completely opened. Combining this with the weight of the payload and the inner surface area of the bucket gives an estimate for the force per unit area adhering the soil to the bucket and also the cohesion between the soil preventing it from falling apart.

Gravel or aggregate material can be distinguished from the finer grained materials based on assuming that washed gravel moves much easier due to the lack of cohesion/adhesion. A large lump of clay and a large rock can be distinguished based on the visual and behavioral properties of the load. A large rock does not deform as it is loaded into the bucket and is likely to suddenly fall out of the bucket once the bucket is tipped enough whereas clay freely deforms during digging and is likely to be difficult to dislodge from the bucket.

In a further embodiment, the method comprises determining a target area shape parameter providing information on a geometric shape and/or dimension of a target area, e.g. by using the sensor data. The target area could particularly be a hole to be filled or the load area of a dump truck. By way of example, the perception data are used to automatically recognize the presence of a nearby truck and, based thereof, to determine the shape and/or dimension of the truck bed, e.g. recognizing the truck bed to be rectangular with a determined length and width. The target shape parameter is then taken into account for the selecting of the dumping mode, e.g. for automatically proposing or setting a sub-configuration of the flowing spread mode, wherein the sub-configuration defines a spreading trajectory to be obtained and/or a spreading area to be obtained. For example, the determining of the target area shape further comprises a determining of a load distribution in the target area, which can then be taken into account, e.g. to provide even loading of a truck bed by a sequence of excavation and dumping processes.

In a further embodiment the system is configured to determine a target position and/or target area, e.g. provided by a dump truck, by user input. For example, the system is configured that a user can select an area or target manually on a user interface, e.g. wherein the area or target is proposed based on the perception data. Furthermore, the user may be provided with an option to select an area and/or target position out of predefined a selection of target areas/positions.

In a further embodiment, the method comprises comparing the material parameter or the set of different material parameters with a job task to be performed by the earth moving machine, the job task including moving of material by the conveying container according to a defined sequence of load operations from a load area and dump operations onto a dump area. For example, a job task may be defined as digging a trench and depositing material into a spoil pile parallel to the trench. Optimal placement of the spoil pile depends on material properties and the way material is unloaded from the bucket. Another example, would be a wheel loader spreading gravel or a wheel loader spreading clay, which requires different movement of the wheel loader and its shovel. According to this embodiment, the providing of the control data takes into account the comparing to provide the control data, e.g. such that a return parameter indicative of dumped material moving back from the dump area to the load area is minimized.

By way of example, the method is implemented by an automated or autonomous excavation system having knowledge of a desired job task to be executed by the earth moving machine. A subsystem performs determination of the material parameter or the set of different material parameters, and the automation system plans or replans the method of achieving the job task based on the selected dump behavior suitable for the current material.

The disclosure further relates to a system for the controlling of a dumping of a load of an earth moving machine, which has a conveying container configured for carrying the load. The system is configured to provide control data according to the method of one of the embodiments described above, for which the system comprises a computing unit configured: to access the sensor data of the step of accessing sensor data according to the method described above; to determine the material parameter or the set of different material parameters according to the step of analyzing the sensor data according to the method described above; to select the dumping mode for unloading the conveying container out of different dumping modes according to the step of selecting a dumping mode according to the method described above; and to provide the control data according to the step of providing control data according to the method described above.

In one embodiment, the system comprises at least one of: a perception sensor, e.g. wherein the perception sensor is embodied as a visually observing sensor, particularly a camera and/or a 3D coordinate measuring device; a humidity sensor; a localization unit, e.g. a GNSS based localization unit; and a fill level sensor configured to measure a fill level of the conveying container.

In a further embodiment, the perception sensor is embodied as a sensor unit comprising optical sensor devices for at least one of: photogrammetry, e.g. stereo imaging and/or structured light imaging; imaging, e.g. by a camera; 3D laser scanning, e.g. by a LiDAR device. The perception sensor may be configured to be mounted on the earthmoving machine and to observe a conveying container surrounding and at least part of the conveying container. In one embodiment the perception sensor is mounted on the cabin of an operator and/or on a boom of the earthmoving machine.

In a further embodiment, the system is configured to access data of a machine sensing unit of the earth moving machine. The machine sensing unit is configured to monitor a movement behavior of the conveying container and/or a first guide component of the conveying container, and/or to monitor a force acting on the conveying container and/or a second guide component of the conveying container.

By way of example, the machine sensing unit provides kinematic information of and/or information on forces acting on a joint of the conveying container and/or the first or second guide component. For example, the machine parameter is provided by at least one of a force sensor, an acceleration sensor, and a torque sensor.

In a semi-automatic embodiment, the system comprises a user interface with a display and an input functionality, e.g. a touch display, configured to provide information based on the material parameter. The information provided to the user could be realized in form of displaying dumping modes and highlighting an appropriate dumping mode appropriate for the machine parameter or set of different machine parameters. By way of example, for soil with high cohesion and adhesion bonds, the system displays different dumping modes and highlights the rap out mode. For soils with other properties the proposed mode could obviously be different. Afterwards, the user could select a dumping mode by selecting a specific mode on the touch display, being guided by the proposal of the system.

In a fully automatic embodiment, the computing unit of the system provides an automated selection of the dumping mode as a function of the material parameter or the set of different material parameters. Also here, the selection could particularly be based on the cohesion and adhesion properties of the soil provided by the material parameter or the set of different material parameters. That means the sensor data provide information on the material to be moved. Afterwards, the computing unit automatically selects a corresponding dumping mode.

If the perception data or data of a fill state sensor indicate that the conveying container hast not been emptied completely, a repeated application of the selection step may follow a dumping follows. The providing of the control data comprises a providing of the control data for each of the different instances of time, so that a repeated dumping based on the last selection step can follow afterwards, especially after the dumping. This procedure can be repeated until the conveying container is empty or a maximum number of repetitions is reached.

The disclosure further relates to a computer program product comprising program code which is stored on a machine-readable medium, or being embodied by an electromagnetic wave comprising a program code segment, and has computer-executable instructions for performing, e.g. when run on a computing unit of a system according to one of the embodiment described above, the following steps of a method according to one of the embodiments described above for providing control data for maneuvering a conveying container: accessing the sensor data of the step of accessing sensor data according to the method described above; determining the material parameter or the set of different material parameters according to the step of analyzing the sensor data according to the method described above; selecting the dumping mode for unloading the conveying container out of different dumping modes according to the step of selecting a dumping mode according to the method described above; and providing the control data according to the step of providing control data according to the method described above.

BRIEF DESCRIPTION OF THE DRAWINGS

The system and method according to the different aspects are described or explained in more detail below, purely by way of example, with reference to working examples shown schematically in the drawing. Identical elements are labelled with the same reference numerals in the figures. The described embodiments are generally not shown true to scale and they are also not to be interpreted as limiting. Specifically.

DETAILED DESCRIPTION

Figure 1:
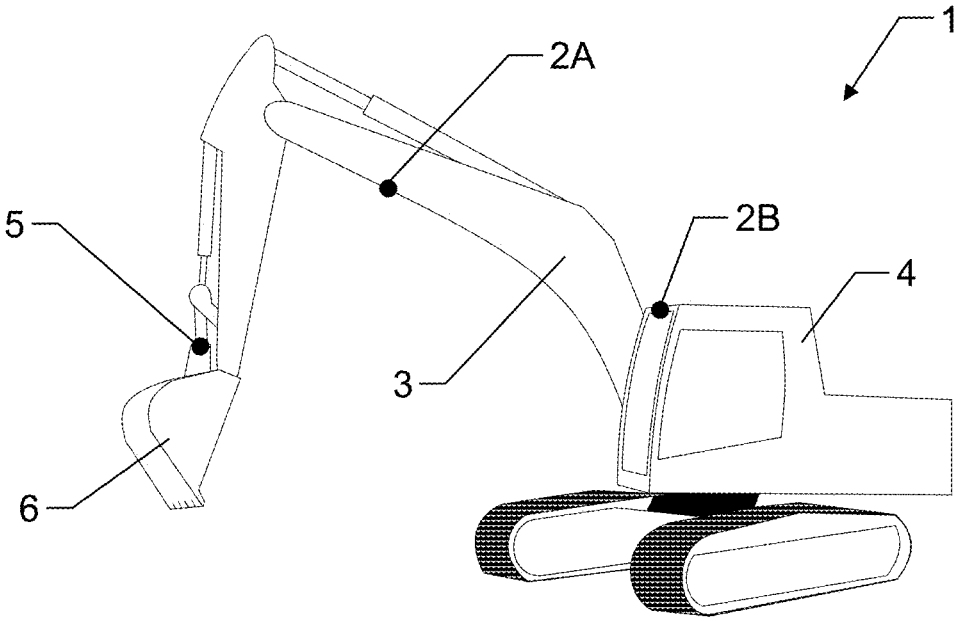
FIG. 1: an example embodiment of an earth moving machine.

FIG. 1 shows an example embodiment of an earth moving machine 1, here an excavator, which can be embodied or upgraded to work according to the method described above. A computing unit mounted on the earth moving machine 1 has access to a perception unit and/or to a machine sensing unit. By way of example, mounting locations 2A, 2B for a perception sensor may be somewhere on the boom 3 of the earth moving machine 1 and/or on the cabin 4 of the earth moving machine 1. The machine sensing unit provides kinematic information for different parts of the earth moving machine 1 and/or information regarding the effects of (e.g. external) forces acting on different parts of the earth moving machine 1, e.g. provided by a torque or force sensor monitoring a joint 5 of the conveying container 6.

The perception unit is configured to monitor an environment of the conveying container 6 and at least a part of the conveying container 6 of the earth moving machine. The data recorded by the perception unit are then used as a basis for a selection functionality for carrying out the selecting of a dumping mode according to the method described above. For example, in an embodiment the perception unit comprises at least one camera. In another embodiment, the perception unit comprises a 3D coordinate measuring device, e.g. embodied as a laser scanner (see FIGS. 2 to 4).

Figure 2:
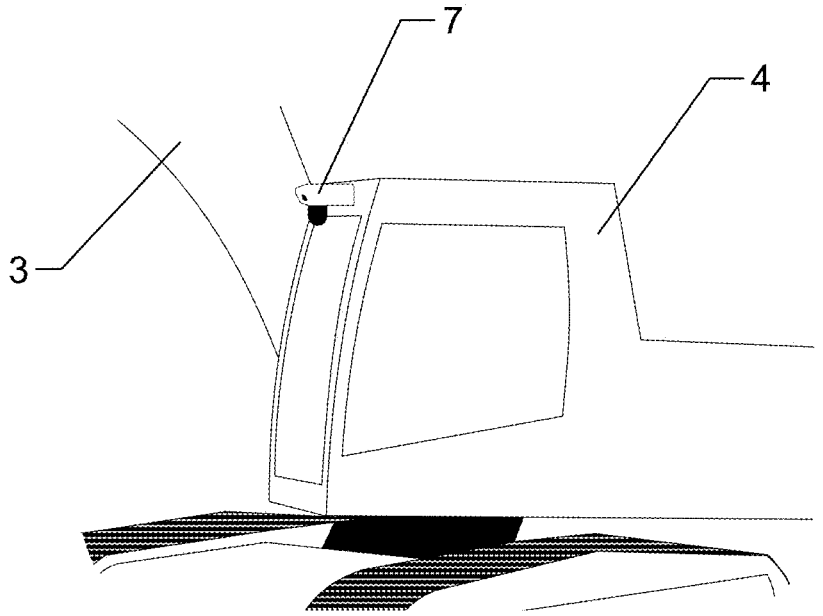
FIG. 2: an example embodiment, wherein a 3D coordinate measuring device is mounted on the cabin of an earth moving machine.

FIG. 2 shows an example embodiment, wherein a 3D coordinate measuring device 7 is mounted on the earth moving machine 1 and used as perception sensor. By way of example, the 3D coordinate measuring device is mounted to the cabin 4 of the earth moving machine and comprises a lidar unit and a camera. The data recorded by the 3D coordinate measuring device 7 are then used as a basis for a selection functionality for the selecting of the dumping mode.

Figure 3:
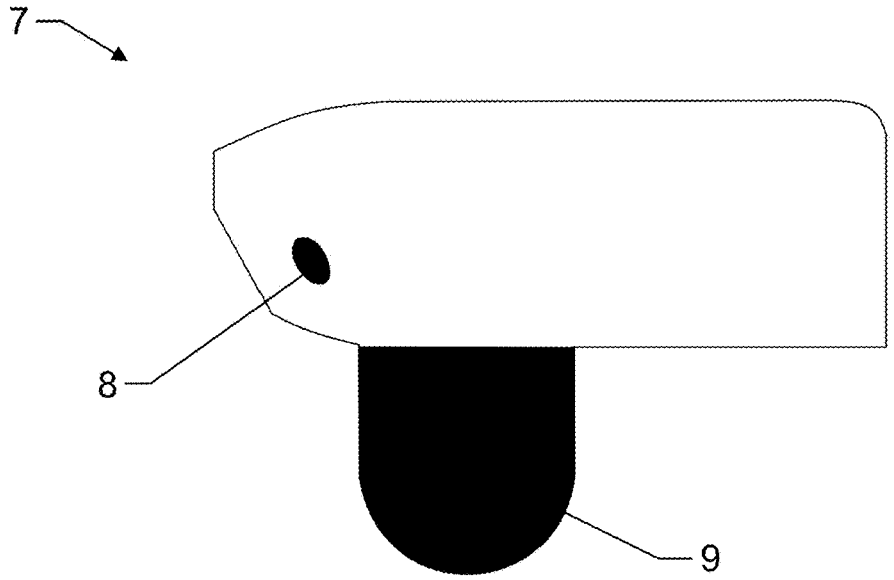
FIG. 3: a close-up view of a sensor head of the 3D coordinate measuring device depicted in FIG. 2.

FIG. 3 shows a close-up view of an example embodiment of a sensor head of a 3D coordinate measuring device 7 as useable in a mounting position on the cabin as depicted by FIG. 2. The sensor head comprises one or multiple cameras 8. For example, in addition to the camera visible in the figure, a further camera is arranged opposite the shown camera (here concealed by the front of the housing of the sensor head). The sensor head further comprises a 3D lidar unit 9, e.g. embodied as a laser scanner.

By way of example, the sensor head further comprises at least one of: a GNSS-antenna configured for generating position data; an inertial measurement unit (IMU) configured for generating IMU data; and a cellular unit configured for transmitting any data to a remote station.

The sensor head is in communication with a computing unit, e.g. arranged remotely in data communication with the sensor head or arranged in the sensor head. The computing unit processes measuring data of the sensor head for generating 3D data of the soil to be moved and the soil in the conveying container. By way of example, the measurement of the lidar unit 9 and the data of the at least one camera 8 are combined, e.g. wherein the lidar sensor captures a 3D point cloud of the environment and the camera data are used for deriving color information.

Figure 4:
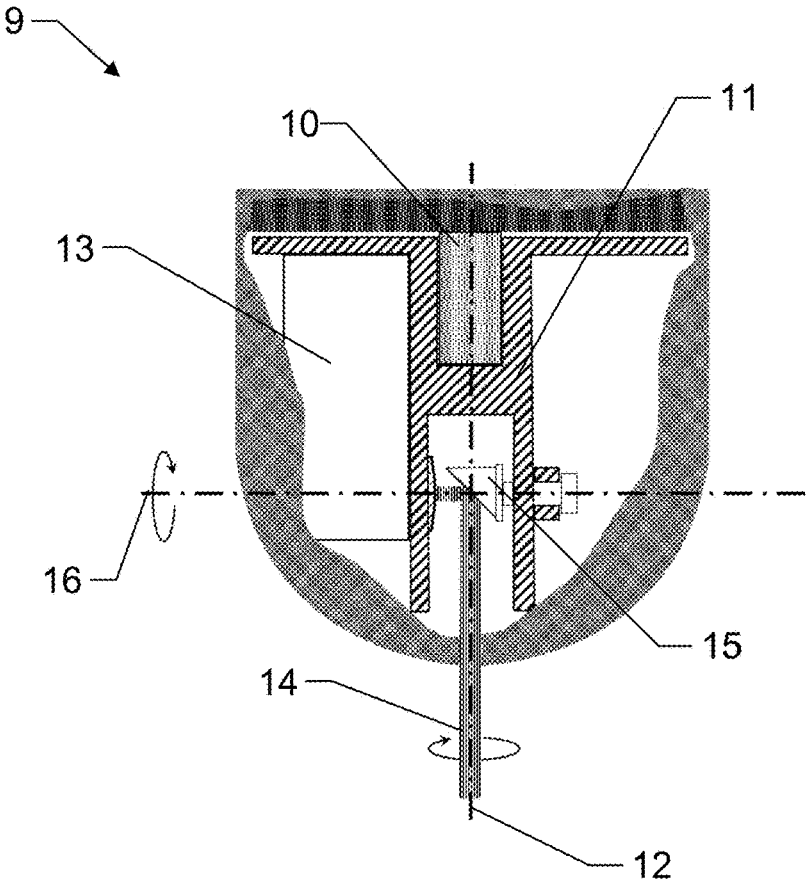
FIG. 4: an example embodiment of a lidar unit of the sensor head of the 3D coordinate measuring device depicted in FIG. 3.

FIG. 4 shows an example embodiment of the lidar unit 9 useable in a sensor head as depicted by FIG. 3. Here, the lidar unit is embodied in the form of a so-called two-axis laser scanner. The laser scanner comprises a base 10 and a support 11, the support being rotatably mounted on the base 10 about a so-called vertical axis 12. Often the rotation of the support 11 about the vertical axis 12 is referred to as azimuthal rotation, regardless of whether the laser scanner, or the vertical axis 12, is aligned exactly vertically. The core of the laser scanner is an optical distance measuring unit 13 arranged in the support 11 and configured to perform a distance measurement by emitting a pulsed laser beam 14. A pulse echo is received from a backscattering surface point of the environment, wherein a distance to the surface point can be derived based on the time of flight, the shape, and/or the phase of the emitted pulse.

The scanning movement of the laser beam 14 is carried out by rotating the support 11 relative to the base 10 about the vertical axis 12 and by means of a rotating body 15, which is rotatably mounted on the support 11 and rotates about a so-called horizontal axis 16. By way of example, both the transmitted laser beam and the returning parts of the laser beam are deflected by means of a reflecting surface integral with the rotating body 15 or applied to the rotating body 15. Alternatively, the transmitted laser radiation is coming from the side facing away from the reflecting surface, i.e. coming from the inside of the rotating body 15, and emitted into the environment via a passage area within the reflecting surface. For the determination of the emission direction of the distance measuring beam 14, many different angle determining units are known in the prior art. For example, the emission direction may be detected by means of angle encoders, which are configured for the acquisition of angular data for the detection of absolute angular positions and/or relative angular changes of the support 11 or of the rotating body 15, respectively. Another possibility is to determine the angular positions of the support 11 or the rotating body 15, respectively, by only detecting full revolutions and using knowledge of the set rotation frequency.

By way of example, the laser scanner is configured to ensure a total field of view of the measuring operation of the laser scanner of 360 degrees in an azimuth direction defined by the rotation of the support 11 about the vertical axis 12 and at least 130 degrees in a declination direction defined by the rotation of the rotating body 15 about the horizontal axis 16.

Figure 5:
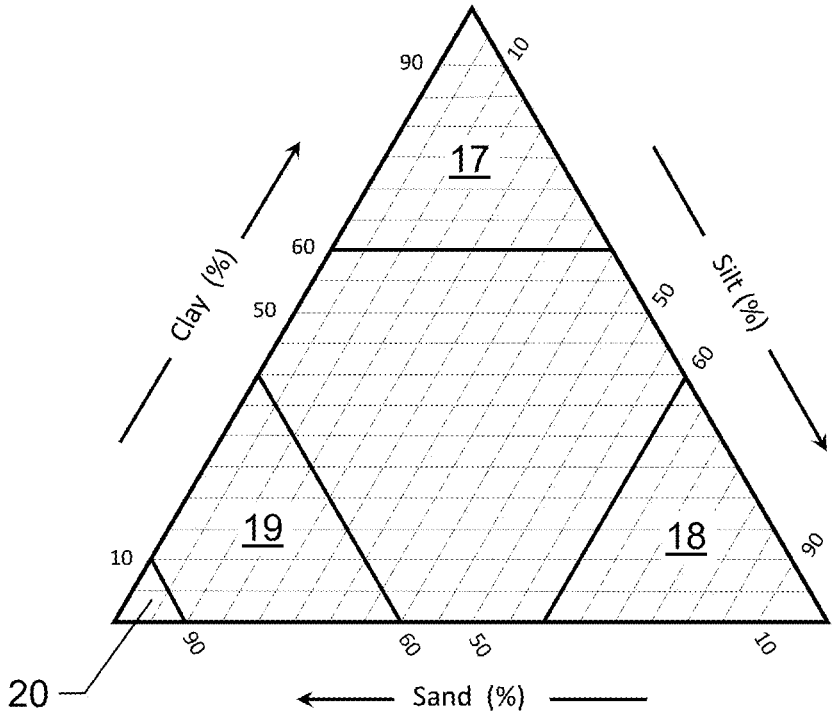
FIG. 5: a possible reference to proportions of sand, clay, and silt for determining different dumping modes based on soil type.

FIG. 5 exemplarily depicts a determining of the material parameter based on proportions of sand, clay and silt. The proportions of clay, silt and sand are plotted on the sides of an equilateral triangle as percentages. On basis of this graph, the soil in concern can be assigned to areas within the triangle associated with different soil types 17, 18, 19, 20. For this purpose, the proportion of sand, silt or clay of the soil is determined with the help of the analysis of the sensor data (e.g. of perception data and/or machine data). For example, 3D images of the soil's surface are used, by combining LiDAR data and camera images. With the help of these representations and analysis of the nature of the surface, the proportion of constituents can then be determined. The analysis can specifically refer to at least one: the color of the surface; the morphology of the surface; grain size; and grain type.

By way of example, the classification is made on the basis of different grain sizes. For this purpose, different grain size classes can be defined. The soil is analyzed and, based thereof, an estimate is made as to what proportion of the soil can be assigned to each class. Based on a predefined classification, which takes into account the percentage of each class, a soil type can then be found following this classification. It makes sense to choose a classification that highlights features of interest.

One possible classification can be made for example in accordance with ISO 14688-1:2002. According to this, sand describes grain sizes between 2 mm and 0.063 mm, silt describes grain sizes smaller than 0.063 mm and larger than 0.002 mm, and clay describes grain sizes smaller than 0.002 mm. Smaller grain sizes typically have a high water absorption capacity, in particular clay swells upon water absorption. Furthermore, smaller grain sizes, such as in the clay range, have significantly higher cohesive and adhesive attraction forces than larger grain sizes such as sand. A high proportion of the fine grain sizes, as in an area 17 with over 60 percent clay, are consequently highly adhesive. They therefore tend to stick to the conveying container and therefore require a special dumping behavior mode such as the rap out. Soils with a high proportion of sand, such as in an area 19 with over 60 percent sand or in an area 20 with over 90 percent, have correspondingly much lower adhesive forces. Soils of this type are particularly suitable for a flowing spread.

By way of example, for particles larger than sand, it is feasible to use a visual or lidar system to directly measure particle sizes for characterization. At the size of sand, silt, or clay the size must be indirectly measured using the properties described. Density and compaction are other properties that can be used.

Figure 6:
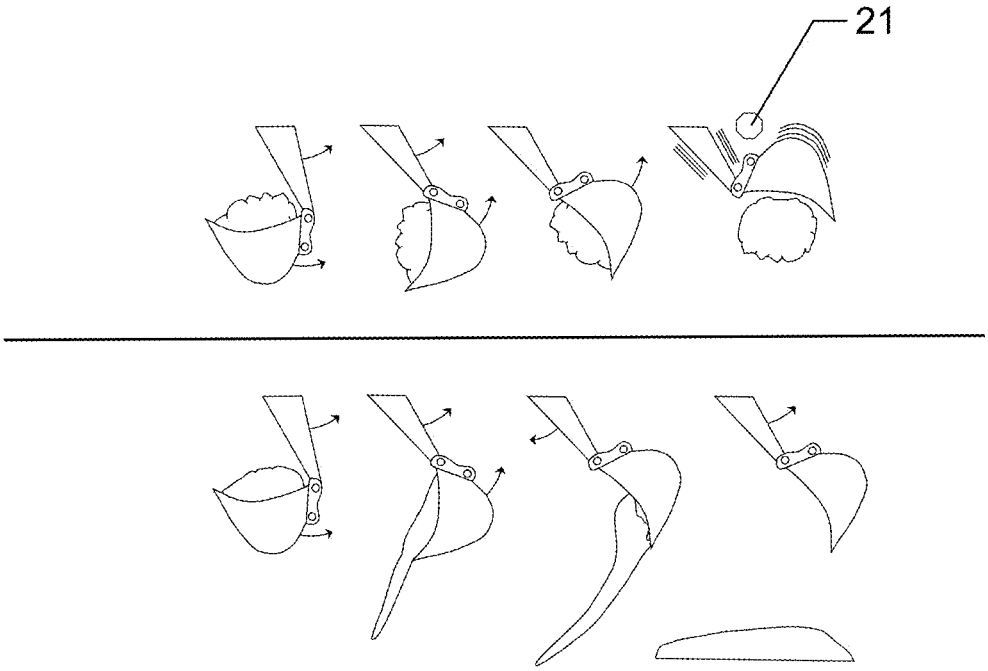
FIG. 6: a schematic depiction of embodiments of a so-called rap out dumping mode (top sequence) and a so-called arm kick out dumping mode (bottom sequence)

FIG. 6 shows a schematic depiction of embodiments of a so-called rap out dumping mode (top sequence, left to right) and a so-called arm kick out dumping mode (bottom sequence, left to right).

The rap out starts (sequence position on the left) with a movement of the machine arm carrying the bucket away from the cabin while the bucket rotates to a position where it opens towards the surface for unloading. This movement continues until the bucket is above the target position and the arm is extended enough to be able to fully open the bucket (second sequence position from the right). For soil types that have weak adhesive properties, the load would have already fallen out of the bucket at this stage. Not so, however, for strongly adhesive soils. Here the central aspect of the rap out becomes important: The bucket (and/or the arm) continues to open at full speed until a mechanical end stop 21 is hit. This causes a strong shaking and vibrating of the bucket and the arm, which helps to loosen the soil from the bucket. If, after this process, sensors determine that the bucket has not yet been emptied, the bucket can be rotated towards a closed position at first, and then rotated again quickly against the end stop. This can be repeated until the bucket is completely empty. The operator does not need to intervene during the entire process, as the movements are automated and the fill level can be monitored with the aid of sensors.

The rap out mode could be applicated when handling soil with high adhesion bonds. For the earth moving machine being an excavator with a boom and the conveying container being a bucket, the bucket rap out involves positioning the machine at the dump location with the bucket level to avoid spilling material and then performing a rap out consisting of dumping the bucket at full speed and maintaining the dump command until the bucket stops abruptly at the end of stroke.

The arm kick out mode comprises a rapid reversion of a movement direction of a part of the earth moving machine, particularly a boom, guiding the conveying container, while the conveying container is oriented so that the load can leave the container. This mode could particularly be used for soils with low adhesion bonds.

For example, in the arm kick out procedure the arm carrying the bucket is first guided away from the cabin while the bucket is gradually opened. In the case of soils with low adhesive properties, the material starts to fall out of the bucket even when the bucket is only slightly open (second sequence position from the left). To empty the bucket quickly, the bucket and arm are opened further. Then, rapidly, the direction of the arm's movement is reversed for a short distance (second sequence position from the right), and immediately after that, the arm is moved further out again (sequence position on the right). The inertia of the mass of the load ensures that it cannot follow the movement of the bucket, especially the reopening movement, and thus the bucket is dumped.

By way of example, for the earth moving machine being an excavator with a boom and a stick, and the conveying container being a bucket, the arm kick out involves positioning the machine near the dump location with the stick tucked in a set distance relative to the desired reach, holding the bucket level to prevent spill. Then dumping the bucket while extending the stick to the desired reach. The bucket dump and stick reach are synchronized such that the bucket open face is in line with the stick when the desired reach is achieved. After that quickly reversing the direction of the stick motion from stick out to stick in and then quickly reversing the direction of the stick motion from stick in to stick out. The benefit of this mode is the reduced amount of time, needed to perform this mode of dumping and the reduced wear and tear on the earth moving machine, compared to the rap out for example. For soils with appropriate characteristics it is therefore desirable to use this mode.

For a wheel loader this mode may include a tap on the brakes in order to "throw" the material out of the bucket using the momentum of the material.

The dumping modes may further comprise a so-called flowing spread mode (not shown) comprising a continuous boom motion with a synchronized, steady emptying of the conveying container. This mode is particularly used for soils with good flowing properties. For example, the flowing spread comprises modes of spreading along a trajectory, e.g. a circle or a straight line, and/or spreading on an area, e.g. a rectangle. Target position and target area are defined by a position in 3D space and optionally vectors defining the area. For example, the vectors define the dimensions and orientation of the area regarding a specific position.

For example, this mode demonstrated by a wheel loader where the bucket is tilted until material starts flowing then the machine is put into forward or reverse and slowly traverse the site, e.g. while adjusting the bucket angle to maintain a steady flow of material out of the bucket as the machine moves.

With a gravel or sand material, the loader may be able to perform a spreading activity as described above. However, with a stickier soil it may be necessary to fully dump the bucket into a pile then back drag the material in order to spread it. A semi-automatic system may tell the operator when spreading is impossible and back dragging is necessary. A fully automatic system may trigger a planning routine to plan for the dump and backdrag when the material is unsuitable for spreading.

In an embodiment the system is configured to take a determined target position and/or target area into account for setting the spreading trajectory and/or spreading area. This could be realized for instance by measuring the target area and the position of this area by parts of the sensor unit, e.g. by laser scanning devices, and subsequently setting the area for the flowing spread referring to this measurements.

For the earth moving machine being an excavator with rotation capabilities, with a boom and the conveying container being a bucket, the flowing spread dumping behavior involves selecting a spreading behavior as mentioned above and then a continuous movement of the boom along the determined trajectory or area together with a synchronized opening of the bucket for an even distribution of the soil. The speed of the flowing spread might be determined by the user or be evaluated automatically by parts of the sensor unit.

For all dumping behavior modes the system may be configured to use information on the fill level of the conveying container from the sensor unit to provide a repeated selection of a dumping mode upon determining that not all material has left the conveying container, until the conveying container is empty or until a maximum number of repetitions is reached.

Figure 7:
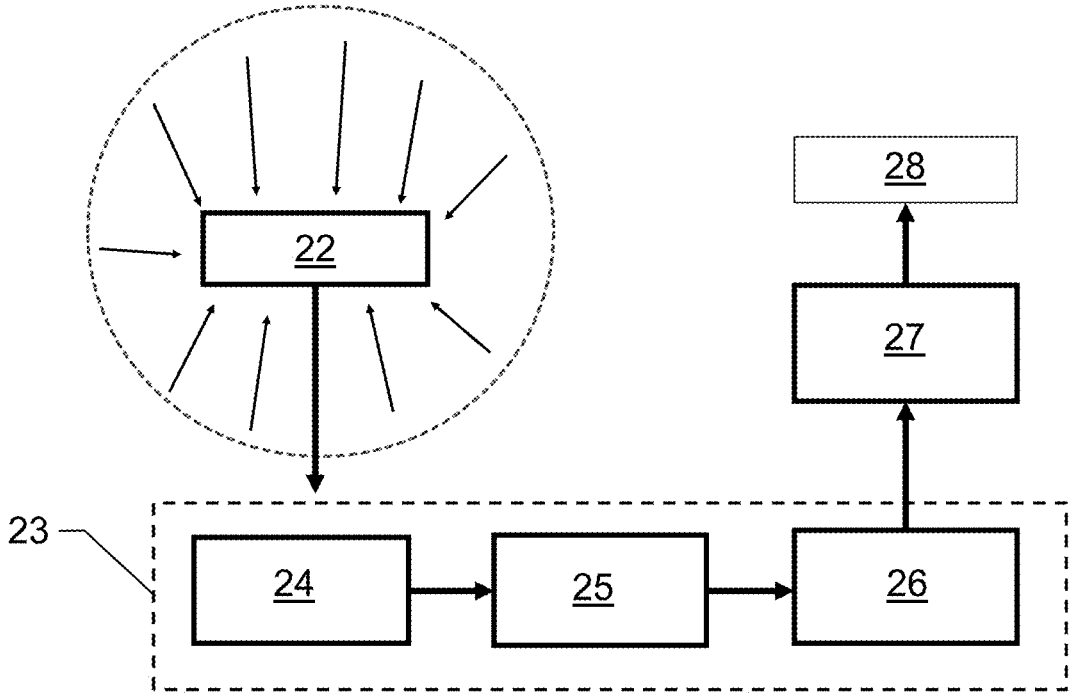
FIG. 7: a block diagram of method steps of an example embodiment of the inventive method for controlling of a dumping of the load of an earth moving machine.

FIG. 7 schematically illustrates an embodiment of the described method for controlling of a dumping of the load of an earth moving machine. The method starts with the acquisitioning 22 of sensor data, e.g. from the environment by means of a perception sensor or about a kinematic machine condition by means of force and torque sensors of the earth moving machine. This can include dump information collected during the previous dump cycle.

Subsequently, a selection step 23 follows. The selection step 23 includes an analyzing 24 of the sensor data for determining 25 of a material parameter or set of material parameters on the basis of this data. This can include various intermediate steps, such as determining cohesion and adhesion properties of the soil. The material parameter or the set of different material parameters is used for selecting 26 of a dumping mode, based on which control data are provided 27. In addition, for example, dump information from previous dump cycles is taken into account, e.g. so that if the machine was unable to empty the bucket without a rap out last cycle, it will use a rap out this cycle because the material has shown a rap out is needed. Or conversely, if a rap out was attempted last cycle but the bucket was empty of material before the rap out occurred, a rap out will not be used this cycle because it is not needed. The earth moving machine then executes the dumping 28 according to the selected dumping mode.

The influence of this dumping may have implications for further method steps. For example, the method is executed again, if the container was not completely emptied. Obviously the conditions of the environment can change for following applications of the method, which leads to a different course of the method.

Although aspects are illustrated above, partly with reference to some preferred embodiments, it must be understood that numerous modifications and combinations of different features of the embodiments can be made. All of these modifications lie within the scope of the appended claims.

The invention claimed is:

1. A method for controlling of a dumping of a load of an earth moving machine, which has a conveying container configured for carrying the load, wherein the method comprises accessing sensor data comprising perception data capturing a conveying container surrounding and at least part of the conveying container and/or machine sensing data providing a machine parameter that is indicative of a force exerted onto the earth moving machine in reaction to material in the conveying container and/or in reaction to an excavation process by the conveying container, analyzing the sensor data to determine a material parameter or a set of different material parameters, the material parameter or the set of different material parameters providing information on an adhesive property of a current load of the conveying container, selecting a dumping mode for unloading the conveying container out of different dumping modes based on the material parameter or the set of different material parameters, and providing control data for maneuvering the conveying container according to the selected dumping mode.

2. The method according to claim 1, wherein the method comprises:

providing of load information of the current load based on the material parameter or the set of material parameters, and receiving user input to provide the selecting of the dumping mode, and/or the selecting of the dumping mode is carried out automatically as a function of the material parameter or the set of material parameters.

3. The method according to claim 2, wherein the method comprises providing dump area information defining a dump location relative to the earth moving machine, and taking into account the dump area information for the providing of the control data.

4. The method according to claim 1, wherein the perception data are visual observation data, particularly comprising camera data and/or 3D coordinate measuring data.

5. The method according to claim 1, wherein the method comprises generating of a machine parameter history of values of the machine parameter and using the machine parameter history to determine the material parameter or the set of different material parameters, particularly wherein the machine parameter history comprises localization and/or time information of an excavating place and/or an excavating time associated with each of the values of the machine parameter.

6. The method according to claim 1, wherein the material parameter or the set of different material parameters provides information regarding at least one of a clay proportion, a silt proportion, and sand proportion of the current load.

7. The method according to claim 1, wherein the sensor data provide moisture data and the material parameter or the set of different material parameters provides information on moisture of the current load.

8. The method according to claim 1, wherein the selecting of the dumping mode comprises selecting a dumping mode out of the following different dumping modes:

a dumping mode invoked by the material parameter or the set of different material parameters indicating a clay proportion of the current load above 60 percent, a dumping mode invoked by the material parameter or the set of different material parameters indicating a sand proportion of the current load above 60 percent and particularly a further dumping mode invoked by the material parameter or the set of different material parameters indicating a sand proportion of the current load above 90 percent, and a dumping mode invoked by the material parameter or the set of different material parameters indicating a silt proportion of the current load above 60 percent.

9. The method according to claim 1, wherein the material parameter or the set of different material parameters categorizes the current load in at least one of the following categories a category defined by grain properties, namely by grain size and/or flow properties, a category defined by material constitution, namely different proportions of different materials, a category indicative of low adhesion material, and a category indicative of high adhesion material.

10. The method according to claim 1, wherein the different dumping modes comprise:

a bucket rap out mode providing movement of the conveying container into an abrupt end stop, a gradual bucket opening mode providing a shock free unloading of the conveying container, a kick out mode providing a rapid stop of a movement of the conveying container or a rapid reversion of a movement direction of the conveying container, particularly by a rapid reversion of a movement direction of a boom guiding the conveying container or by an application of brakes of the earth moving machine, an arm kick out mode providing a rapid reversion of a movement direction of a boom guiding the conveying container, and a flowing spread mode providing a continuous boom motion with a synchronized emptying of the conveying container.

11. The method according to claim 10, wherein the method comprises determining a target area shape parameter providing information on a geometric shape and/or dimension of a target area, particularly by using the sensor data, and taking into account the shape parameter for the selecting of the dumping mode, particularly for automatically proposing or setting a sub-configuration of the flowing spread mode, wherein the sub-configuration defines a spreading trajectory to be obtained and/or a spreading area to be obtained.

12. The method according to claim 1, wherein the method comprises comparing the material parameter or the set of different material parameters with a job task to be performed by the earth moving machine, the job task including moving of material by the conveying container according to a defined sequence of load operations from a load area and dump operations onto a dump area, wherein the providing of the control data takes into account the comparing to provide the control data, particularly such that a return parameter indicative of dumped material moving back from the dump area to the load area is minimized.

13. A system for the controlling of a dumping of a load of an earth moving machine, which has a conveying container configured for carrying the load, wherein the system is configured to provide control data according to the method of claim 1, for which the system comprises a computing unit configured to access the sensor data of the step of accessing sensor data, to determine the material parameter or the set of different material parameters according to the step of analyzing the sensor data, to select the dumping mode for unloading the conveying container out of different dumping modes according to the step of selecting a dumping mode, and to provide the control data according to the step of providing control data.

14. The system according to claim 13, wherein the system comprises at least one of:

a perception sensor, particularly wherein the perception sensor is embodied as a visually observing sensor, more particularly a camera and/or a 3D coordinate measuring device, a humidity sensor, a localization unit, particularly a GNSS based localization unit, and a fill level sensor configured to measure a fill level of the conveying container.

15. The system according to claim 13, wherein the system is configured to access data of a machine sensing unit of the earth moving machine, wherein the machine sensing unit is configured to monitor a movement behavior of the conveying container and/or a first guide component of the conveying container, and/or to monitor a force acting on the conveying container and/or a second guide component of the conveying container.

16. The system according to claim 14, wherein the system is configured to access data of a machine sensing unit of the earth moving machine, wherein the machine sensing unit is configured to monitor a movement behavior of the conveying container and/or a first guide component of the conveying container, and/or to monitor a force acting on the conveying container and/or a second guide component of the conveying container.

17. A computer program product comprising program code which is stored on a non-transitory machine-readable medium, and has computer-executable instructions for performing, in particular when run on a computing unit of a system, the steps of the method according to claim 1.

18. A computer program product comprising program code which is stored on a non-transitory machine-readable medium, and has computer-executable instructions for performing, in particular when run on a computing unit of a system, the steps of the method according to claim 12.

* * * * *